US006315424B1

(12) United States Patent
Hui

(10) Patent No.: US 6,315,424 B1
(45) Date of Patent: Nov. 13, 2001

(54) UNDERWATER SAFETY LIGHTING DEVICE FOR SWIMMING POOLS

(75) Inventor: Joseph W. T. Hui, Mountain View, CA (US)

(73) Assignee: Smartpool Incorporated, Toronto (CA)

( * ) Notice: Subject to any disclaimer, the term of this patent is extended or adjusted under 35 U.S.C. 154(b) by 0 days.

(21) Appl. No.: 09/490,321

(22) Filed: Jan. 24, 2000

(51) Int. Cl.[7] ..... F21V 25/00; F21V 33/00

(52) U.S. Cl. ..... 362/22; 362/101; 362/276; 362/802; 362/318; 362/477

(58) Field of Search ..... 362/22, 276, 802, 362/96, 101, 318, 145, 253, 477, 258

(56) References Cited

U.S. PATENT DOCUMENTS

| | | | | |
|---|---|---|---|---|
| 3,816,740 | | 6/1974 | Rambusch et al. . | |
| 4,053,758 | | 10/1977 | Shaw . | |
| 4,216,411 | * | 8/1980 | Ehret et al. | 315/118 |
| 4,394,716 | | 7/1983 | Campagna et al. . | |
| 4,503,489 | | 3/1985 | Duerr et al. . | |
| 4,574,337 | | 3/1986 | Poppenheimer . | |
| 4,779,174 | * | 10/1988 | Staten et al. | 362/158 |
| 4,947,304 | | 8/1990 | Payne et al. . | |
| 5,016,151 | | 5/1991 | Mula . | |
| 5,045,978 | | 9/1991 | Gargle . | |
| 5,051,875 | | 9/1991 | Johnson . | |
| 5,089,945 | | 2/1992 | Mula . | |
| 5,299,103 | * | 3/1994 | Kielland | 362/101 |
| 5,607,224 | | 3/1997 | Tobias et al. . | |
| 5,622,422 | | 4/1997 | Rodgers . | |
| 5,800,041 | * | 9/1998 | Poggi | 362/101 |
| 5,842,771 | * | 12/1998 | Thrasher et al. | 362/101 |
| 6,021,033 | * | 2/2000 | Benham et al. | 361/42 |

* cited by examiner

*Primary Examiner*—Sandra O'Shea
*Assistant Examiner*—David V. Hobden
(74) *Attorney, Agent, or Firm*—Birch, Stewart, Kolasch & Birch, LLP

(57) ABSTRACT

An underwater safety lighting device for lighting water beneath a surface (4) of the water in a swimming pool is provided. A water-tight light housing (1) is disposable beneath the surface (4) of the water in the pool and has a lens (5) removably attached to a front side (6) of the light housing (1), a light-emitting source (12) is secured within the light housing and a concaved light reflector (9) is secured within the light housing. The light-emitting source (12) is disposed above a conjugate axis (21) of the concave light reflector (9). An aperture (20) is disposed entirely in an upper one-half (21) of the light reflector (9) for receiving the light-emitting source (12). A control housing (2) is disposable out of the water of the pool and has a control device (26). An elongated connector (3) having a lower connector end (28) connects with a light housing connection portion (22) and an upper connector end (29) connects with a support of the pool. A passageway (30) therein passes electrical wires (31) from the power supply housing (2) to the light housing (1).

22 Claims, 6 Drawing Sheets

UNDERWATER SAFETY LIGHTING DEVICE FOR SWIMMING POOLS

The present invention relates to an underwater safety lighting devices for lighting water beneath the surface of water in a swimming pool, and more particularly to such devices which illuminate the water in a swimming pool without causing undue and distracting water surface glare and reflections of that illumination.

BACKGROUND OF THE INVENTION

Underwater lighting devices used in swimming pools for safety and convenience reasons must be so protected from contact with the water in the pool that the chances of an electrical short in the pool are minimized to the greatest extent possible. In connection with in-ground pools, electrical lighting devices are normally mounted in the walls of the pool and are sealed in the wall by elaborate and costly encasements (see U.S. Pat. Nos. 4,216,411; 5,607,224; 5,045,978; 5,051,875; and 4,574,337). Such electrical lighting devices are intended to be installed, maintained and serviced only by professional, qualified technicians. In regard to above-ground pools, these are much less expensive pools than in-ground pools and are often installed and maintained by the homeowner. Since the walls of an above-ground pool are made of thin flexible materials, e.g. plastics or light metal panels and the like, underwater electrical lighting devices cannot be easily mounted through the walls of the above-ground pool, as they are with in-ground pools (see U.S. Pat. No. 4,503,489) and should be mounted on pool wall structures, e.g. metal or plastic support ledges and the like. Since such underwater electrical lighting devices would, most often, be installed and maintained by the homeowner of the above-ground pool, such lighting devices must be easily installed (without any substantial chance of harmful error), easily maintained (again without any substantial chance of harmful error), and relatively inexpensive.

Heretofore, the lighting of above-ground swimming pools has been achieved, mainly, by lighting devices that mount, at least in part, above the surface of the water in the pool and are attached to some upper structure of the pool (see U.S. Pat. No. 4,053,758). This allows an inexpensive lighting device which can be easily maintained by the homeowner and is simple to install. However, such lighting devices mainly illuminate the surface of the pool, and much of the light is reflected from that surface as glare and does not enter into the depths of the water in the above-ground pool. As a result of the glare and lack of lighting of the depths, during the evening hours, it is difficult to see what objects may be in the above-ground pool. It is, of course, a safety concern if the above-ground pool lighting devices do not illuminate substantially all of the depths of the water in the pool, and one cannot accurately see if a child, for example, a pet or hazardous object may be in the depths of the pool.

Some attempts have been made to provide underwater lighting devices for above-ground pools, but these devices suffer from a number of disadvantages. Firstly, and mainly, they are simply waterproofed adaptations of lighting devices designed for use in environments other than under water. Some use self-contained batteries (see U.S. Pat. No. 4,394,716). Others use sealed beam lamps (see U.S. Pat. No. 5,089,945) or sealed lamps (see U.S. Pat. No. 4,947,304). The illumination, therefore, is spread over a large conical angle, symmetric to the reflector conjugate axis and much of that light travels to the surface of the pool water where it is reflected. The use of a reflector helps to direct light to the front. However, conventional reflector designs limit the light beam angle to well below 180°. In addition, these adaptations require very special waterproofing and cannot be maintained by the usual homeowner. Indeed, many of these devices should not be installed by the average homeowner.

It would, therefore, be of a decided advantage to the art to provide an underwater safety lighting device for swimming pools, and especially above-ground swimming pools. It would be a further advantage to provide such a device which can be simply and easily installed by the homeowner, easily and safely maintained by the homeowner, and one which does not cause glare or transmit substantial light to the surface of the water where it is lost to the atmosphere but transmits most of the light into and to the depths of the pool, such that objects in the pool can be easily observed during the dark hours.

BRIEF SUMMARY OF THE INVENTION

The present invention is based on an underwater safety lighting device being separated into two parts, i.e. a water-tight light housing which is disposable beneath the surface of the water and a control housing disposable out the pool water. These two parts of the device are electrically connected, e.g. by electrical wires. Since the control housing is out of the water and only the light housing is submerged under the water, there is an opportunity for designing the light housing with special removable lens and light reflector such that the light emanating from the light housing is directed, mainly, laterally sidewise and downwardly into the water, so as to avoid glare and substantial light being reflected from the surface of the water and, thus, not fully illuminating the pool. This arrangement with the control housing being disposed out of the water of the pool and only the light housing being suspended in the water allows a very lightweight light housing. This provides an opportunity for the light housing to be supported without fear of breaking from the pool by wave action or buoyancy in the pool. It also provides the opportunity for substantial safety features to be included in the light housing/control combination. The present device may be used with in-ground or above-ground pools, but it is especially useful for above-ground pools.

Thus, briefly stated, the present invention provides an underwater safety lighting device for lighting water beneath a surface of water in a swimming pool. The device comprises a water-tight light housing disposable beneath the surface of the water. The light housing comprises an at least partially transparent lens removably attached to a front side of the light housing in a water-tight manner. A light-emitting source is secured within the light housing. A concaved light reflector is secured within the light housing such that the light-emitting source is above the conjugate axis of the concaved light reflector. There is an aperture disposed entirely in an upper one-half of the light reflector for receiving therethrough the light-emitting source. The light housing also has a light housing connection portion.

A control housing is disposable out of the water in the pool and comprises a power source and a control device.

An elongated connector has a lower connector end for connecting to the light housing connection portion. An upper connector end is provided for connecting to an upper portion of the pool, and a passageway in the elongated connector passes electrical wires from the control housing to the light housing.

Most preferably, there is also provided a low water sensor which interrupts power to the light housing by action of the control device when the light housing is not beneath the surface of the water. Also, most preferably, there is a leak water sensor which interrupts power to the light housing by action of the control device when water leaks into the light housing.

DESCRIPTION OF PREFERRED EMBODIMENTS

Figure 1:
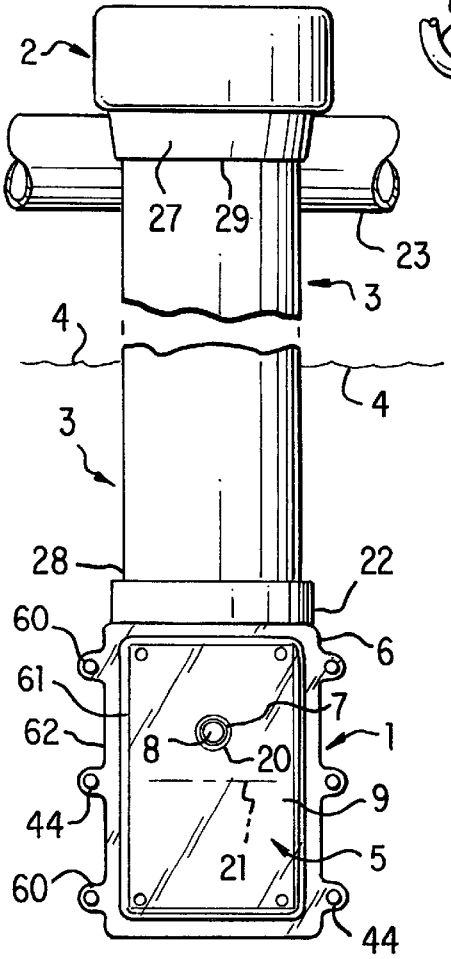
FIG. 1 is a schematic front elevation of an embodiment of the device of the present invention.

As noted above, the present device may be used with both in-ground pools and above-ground pools, but it is especially useful with above-ground pools. Thus, for sake of conciseness in this specification, the invention will be illustrated in connection with the preferred embodiment of above-ground pools.

Referring to FIGS. 1 through 4, one embodiment of the present lighting device comprises a water-tight light housing, generally 1, a control housing, generally 2, and an elongated connector, generally 3. The water-tight light housing 1 is disposable beneath the surface 4 of the pool water and comprises an at least partially transparent lens 5 removably attached to a front side 6 of the light housing 1 in a water-tight manner. A light-emitting source 12 is secured within the light housing 1. A concaved light reflector 9 (see especially FIGS. 2, 4, 5 and 6) is also secured within the light housing. The light-emitting source 12 may be any conventional source, such as a filament of a light bulb 8 secured in a socket 7, or a virtual object of a light source formed by a mirror reflection or lens refraction or fiber optics. However, since a conventional bulb is a preferred embodiment, the invention will be illustrated with a bulb, but it is to be understood that the bulb may be replaced by any of the foregoing light-emitting sources.

Figure 4:
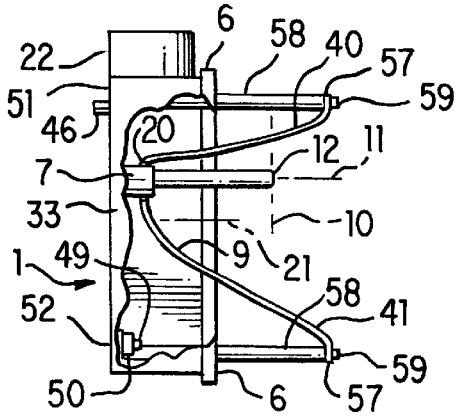
FIG. 4 is a side view of the light housing with the lens removed and partially cut away so as to show mounting of a lighting bulb and a safety sensor therein.
Figure 5:
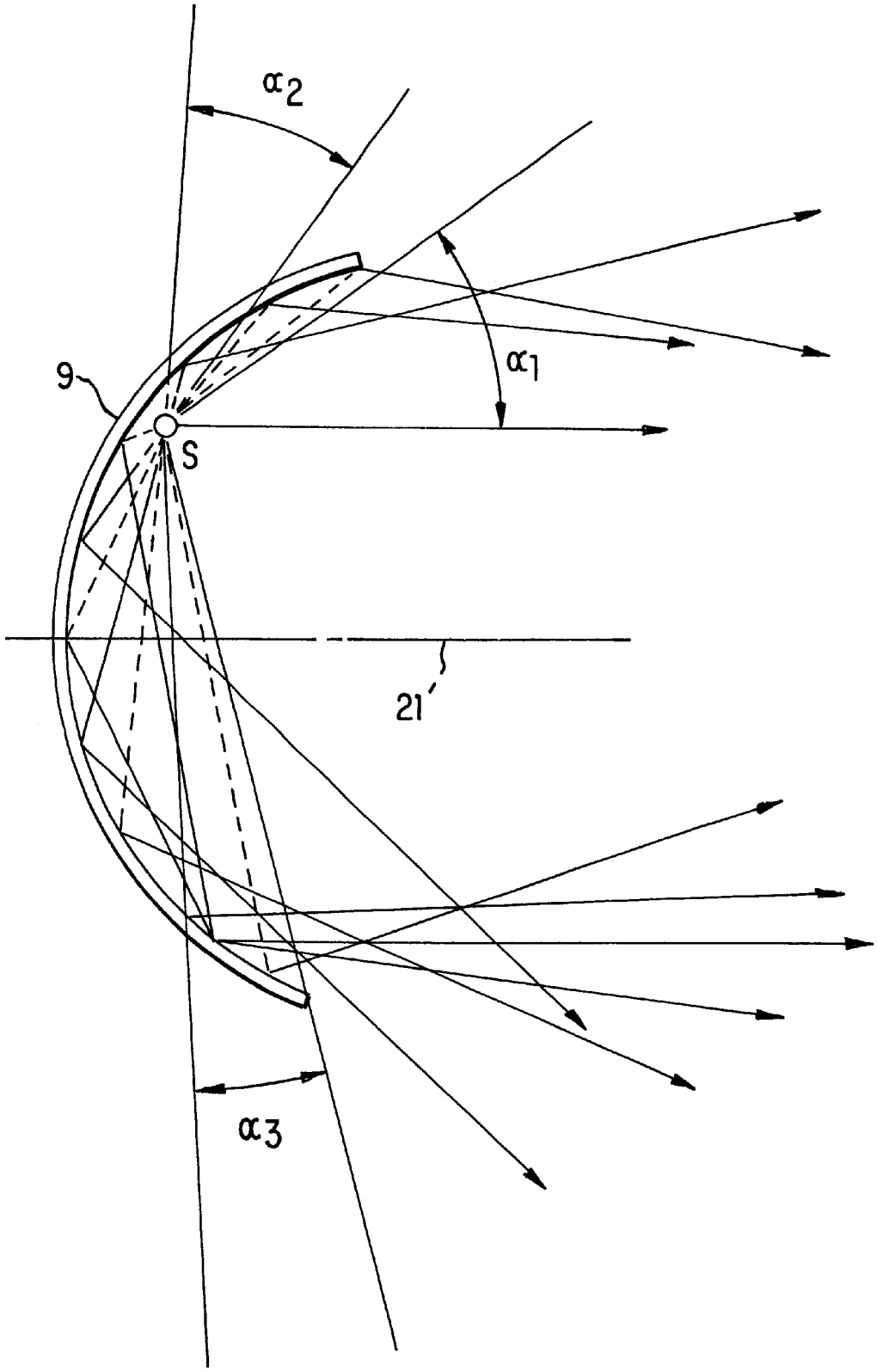
FIG. 5 is a schematic drawing of a curvature of the reflector.

The source 12 is placed above the conjugate axis 21 of a concave reflector 9, as shown especially in FIG. 5. An aperture 20 (see FIG. 1) is disposed entirely in an upper one-half of reflector 9, indicated in FIGS. 1, 2 and 4 by dashed line 21, which also shows the conjugate axis of the reflector 9. The aperture 20 receives therethrough at least one of the bulb socket 7 and bulb 8. The light housing 1 also has a light housing connection portion 22.

There is an at least water-resistant control housing 2 disposable out of the water in the pool and attachable to an upper portion of the pool, and particularly in the case of an above-ground pool, an upper portion of a support 23 for the above-ground pool. The control housing has an electrical power supply 24 and a power control element 25, e.g. an off/on switch with or without a dimmer control (see FIG. 7), a control device 26 (see FIG. 2) and a control housing connection portion 27.

An elongated connector 3 comprises a lower connector end 28 for connecting with the light housing connection portion 22, preferably, in a water-tight manner, an upper connector end 29 for connecting with the control housing connection portion 27 and a passageway 30 (see FIG. 2) therein for passing electrical wires 31 from the power supply housing 2 to the light housing 1. The wires 31, at least, must be passed into light housing 1 in a water-tight manner.

Figure 2:
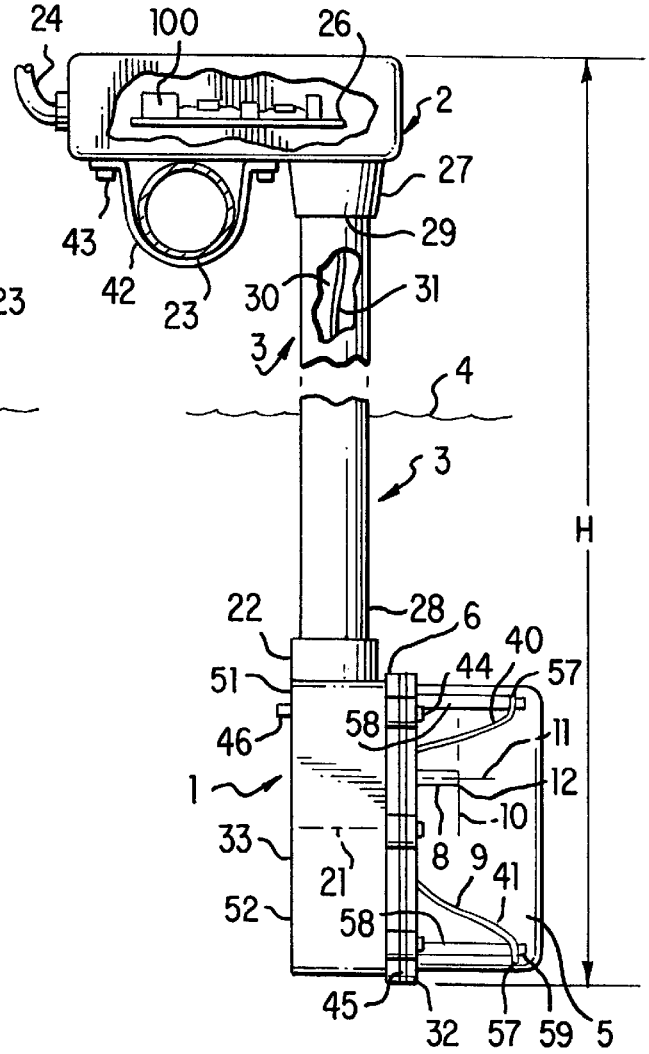
FIG. 2 is a schematic side elevation of the device of FIG. 1.
Figure 3:
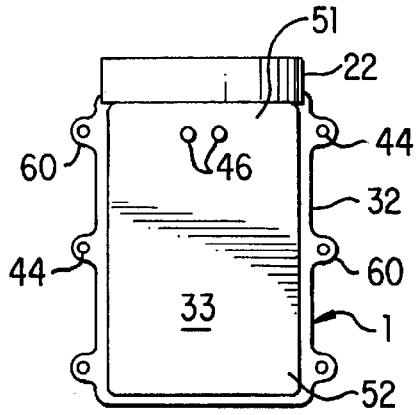
FIG. 3 is a back elevation of the light housing of FIG. 1.

In order to make the light housing 1 water tight, it is only necessary to provide a water-tight seal between lower connector end 28 and light housing connection portion 22 (or a water-tight seal of wires 31 passing into housing 1), as well as between front side 6 and mounting flange 32 of the lens 5 (see FIG. 2). Since, in a preferred embodiment, the light housing 1, elongated connector 3 and the control housing 2 are all made of water and electrical-resistive plastic, e.g. polystyrene, polybutylene, polyolefins, nylon, polyesters and the like, the water-tight seal between connection portion 22 and lower connector end 28 may simply be made by welding or gluing the two together. However, since it is important that the homeowner be able to change bulb 8 in the light housing when there is a failure in the bulb, the mounting flange 32 should be made water tight with front face 6 by means other than gluing or welding. The seal can be by a variety of means, including a formed-in-place gasket or a precut rubber gasket or a precut synthetic polymer gasket. The gasket should have, substantially, the shape of mounting flange 32, as seen in FIG. 3. FIG. 2 illustrates the sealing in the form of a gasket 45.

The height H (see FIG. 2) of the device should be such that the light housing 1 can be totally immersed into the pool to a depth where light emitted from the light housing illuminates most of the water in the pool, including the depths of the pool and, preferably, the bottom of the pool. Preferably, the light housing is disposed near the surface of the water, e.g. within 2 to 6 inches of the surface of the water, but for deeper pools the distance may be longer. Thus, the height H, therefore, may vary with the depth of the pool. However, generally speaking, the height will be from as little at 5 inches to as much as 40 inches. Mainly, that height will be somewhere between about 8 inches and 20 inches. The connector 3 will be usually about at least 3 inches in length.

The lens 5 must be at least partially transparent, and preferably is entirely transparent, but for even greater direction of the light emitted from the light housing 1, portions of the lens 5 may be made opaque or only translucent. For example, the upper portion of lens 5 may be made cloudy or have a reflective surface on the inside thereof, e.g. an aluminum foil or coating, so as to minimize the amount of the light reaching and being reflected from the surface 4 of the water in the pool. In addition, the lens 5 may include lenticular sections for dispersal of the light, especially, in a direction transverse to the longitudinal axis 11 of bulb 8 (see FIG. 2).

The bulb socket 7 and bulb 8 (or other source, as noted above) may be of conventional design and, preferably, is so, such that the homeowner can easily remove the bulb and replace the bulb with a new bulb when there is a bulb failure.

The bulb socket 7 is secured within the light housing 1 by any conventional means, but preferably, that socket is simply glued or welded or bolted to the back side wall 33 (see FIGS. 2, 3 and 4), although any means of mounting may be used, as desired, but it is preferred that the mounting does not involve piercing the walls of the light housing (which would require additional sealing).

The light reflector 9 may be made of any reflective material, such as aluminum, stainless steel, galvanized steel, aluminum-covered plastic, mirrored glass and the like, but preferably the reflector is made of stainless steel having a thickness such that the reflector can be bent and configured, as explained below, e.g. from about 4 mils to about 15 mils in thickness.

The light reflector 9 is disposed in part behind and in part in front of plane 10 (see FIGS. 2 and 4), which plane is perpendicular to a longitudinal axis 11 of the bulb 8 and at the light generating source 12 of the bulb 8, e.g. filament or reflected light, etc.

As can best be seen from FIGS. 2 and 4, light emitting from source 12 will by natural scatter of the light from the source 12 strike upper areas 40 and lower areas 41 of reflector 9. As can be seen from FIGS. 2 and 4, light striking upper area 40 will be reflected by reflector 9 in a generally outwardly and downwardly direction, while light striking lower area 41 will be reflected generally outwardly, because of the particular curvature in the reflector 9, as explained more fully below. Those effects of the reflector configuration are further enhanced by source 12 being disposed above the conjugate axis, indicated by dashed line 21 of the light reflector 9, again as explained more fully below. This, again, increases the amount of light that is directed toward the pool depth and minimizes the amount of light that reaches and is reflected from the surface 4 of the water, as explained above.

Control housing 2 may be mounted on an upper portion of the pool, and in the case of an above-ground pool on a pool support 23 (see FIGS. 1 and 2) by any desired manner, but FIG. 2 shows that mounting by way of a conventional clamp 42 secured to control housing 2 by conventional fasteners 43, e.g. screws, bolts, nuts and the like.

Lens 5 is removably attached to front side 6 of the light housing 1 by conventional housing fasteners 44, e.g. bolts, screws and the like. Thus, if a bulb burns out, the homeowner need only loosen fasteners 43 to remove clamp 42, remove the lighting device from the water, loosen, for example, housing fasteners 44, remove lens 5 and replace bulb 8, with that process being reversed after replacing the bulb. However, to ensure that a water-tight light housing is achieved with such bulb replacement, it is preferable that gasket 45 (see FIG. 2) be made of rubber or impressionable synthetic plastic and precut to specifically mate with front side 6 and mounting flange 32. Such a precut gasket will ensure that the replaced lens 5 (after changing a bulb) will form a water-tight seal with front side 6.

Most preferably, a low water sensor 46 (see FIG. 3) interrupts power to the light housing 1 by action of the control device 26 when the light housing 1 is not beneath the surface 4 of the water. The low water sensor 46 can take a variety of forms, but a simple form is where two electrodes (made of a conductive metal) protrude through back side wall 33 and are spaced apart. Since the water in the pool, with conventional antibacterial agents, such as chlorine, will be conductive, control device 26 can sense when a small current flows (amperage or voltage) between those two electrodes and, therefore, determine that the light housing 1 is beneath the surface 4 of the water. On the other hand, if no current flows between those two electrodes, when the light housing 1 is above the surface 4 of the water, control device 26 will detect such lack of current flow and interrupt the power to the light housing 1. This avoids heat build-up in and damage to light housing 1 by bulb 8 when the housing is out of the water, e.g. water leaking from the pool.

Also, most preferably, a leak water sensor 50 (see FIG. 4) interrupts power to the light housing 1 by action of the control device 26 when water leaks into the light housing. Here again, as a preferred embodiment, two electrical conducting electrodes 49 (see FIG. 4) are placed at the bottom portion 52 of the light housing 1. Similar to that described above in connection with the low water sensor, if the control device 26 detects a current flow between the two electrodes 49 of the sensor 50, then, obviously, water has leaked into light housing 1 and the power to the light housing is interrupted.

While there is some latitude in where the two above-mentioned sensors may be located, preferably, the low water sensor 46 is disposed on an outside upper portion 51 of light housing 1. Also, while the leak water sensor 50 may be disposed at a number of places, preferably it is disposed within the light housing 1 at a lower portion 52 thereof.

Figure 7:
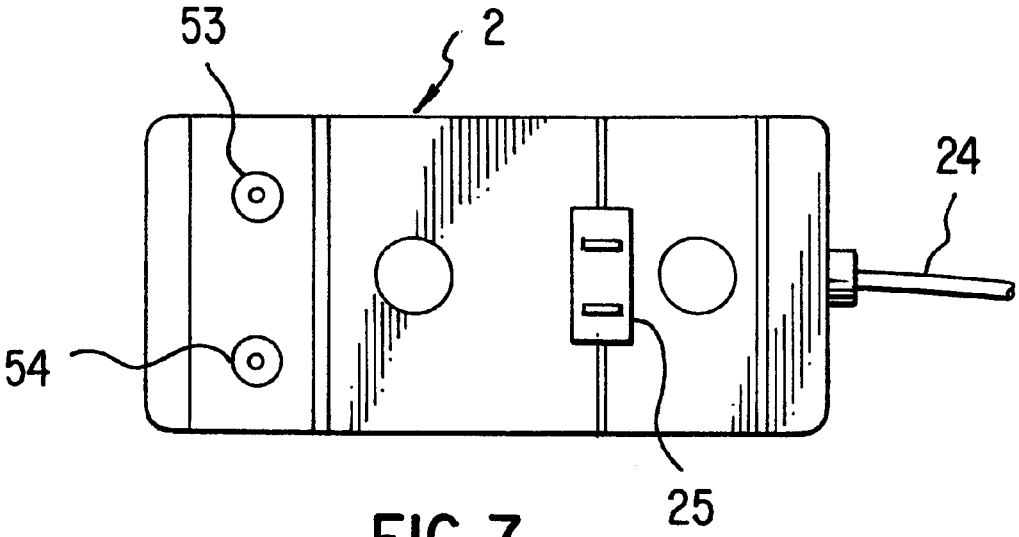
FIG. 7 is a top view of the control housing.

Referring now specifically to FIG. 7, it is preferable that a power on indicator 53 indicates when power is passing from the control housing 2 to the light housing 1. As shown in FIG. 7, the power on indicator 53 warns the homeowner that the power is on to the light housing 1, and, therefore, the unit should not be removed or tampered with until that power is interrupted. While the power on indicator 53 can take a variety of forms, a visible lamp, e.g. an LED red lamp, is most appropriate for this application, as shown in FIG. 7.

It is also preferable that a light sensor 54 interrupts power to the light housing 1 by action of the control device 26 when the light sensor 54 is exposed to light. This simply turns the power off to light housing 1 when it is not dark. The light sensor 54 may take a variety of forms, but a conventional photoelectric device or a Cds or light transistor is preferred. Alternatively, a start switch may have a conventional timer element to automatically turn off the power after a preset or variable time.

As noted above, it is preferred that the light housing is made of a non-electrical conductive and water resistive material, e.g. plastics. This will avoid corrosion and failure in the water of the pool. For the same reason, it is preferred that the connector 3 is also made of a non-electrical conductive and water resistive material, e.g. a plastic, and that, correspondingly, control housing 2 is made of a non-electrical conductive and water resistive material, e.g. plastic.

Turning now to FIG. 5, this figure is a side view showing a light source (spot) S placed at a distance from and in the upper portion of the reflector above the conjugate axis 21. For simplicity, FIG. 5 shows a spherical reflector. As can be seen, most of the light beams (designated by arrows) coming out from the reflector are going straight out or slightly downwardly. Certain portions of light, $\alpha_1$, $\alpha_2$ and $\alpha_3$ (e.g. a total of 21%), have reflected light pointing upwardly. This is an advantage over conventional light reflector designs (e.g. 50% of the total pointing up). The curvature can be twisted at certain portions of the reflector to eliminate $\alpha_2$ and $\alpha_3$, e.g. more in keeping with the curvatures of FIGS. 2 and 4. Also, $\alpha_1$ can be reduced by moving the source (spot) S further away from axis 21, or extending the upper portion of the reflector, again, somewhat as shown in FIGS. 2 and 4. Even without any such reflector modification, all escaped light beams have incident angles significantly greater than a critical angle when they strike the water surface 4. Thus, light coming out from the reflector is essentially contained within the pool. As a matter of fact, the incident angles are greater than that shown in FIG. 5 because of refraction through the lens 5.

Figure 6:
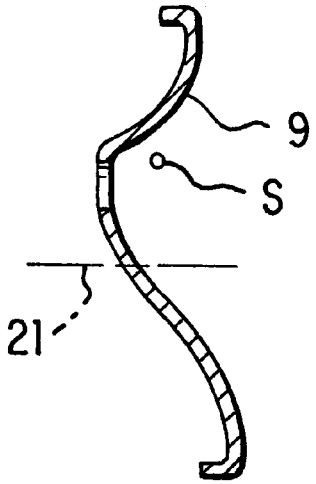
FIG. 6 is a schematic drawing of the reflector in a bent configuration.

FIG. 6 shows a typical bent curvature of reflector 9, as explained in connection with FIG. 5. Greater bending may be use in the nature of the bending shown in FIGS. 2 and 4.

However, the critical point is that the light emitting source (spot) 12, in the form of a filament or reflected light, etc., be placed above the conjugate axis 21. This is enhanced by the combination of the particular curvature of the reflector and the particular source (spot). A combination, for example, of a 1-D light spot and a reflector with a 3D object is quite useful. This ensures that light emitted from source 12 will mainly emanate from reflector 9 in a generally laterally and downwardly direction and very little of the light will be reflected from the surface 4 of the water in the pool.

It is preferred that reflector 9 is under tension when mounted in light housing 1. This not only ensures that the reflector 9 will be stable from a mechanical point of view, i.e. avoids movement upon wave action in the pool, but causes that reflector 9 to form a more desired curvature, as explained above, and be spaced from all components in the light housing 1, with the possible exception of the bulb socket 7 or the bulb 8. The reflector is mounted in light housing 1 (see FIGS. 2 and 4) by fastening reflector ends 57 to stantions 58 by way of stantion fasteners 59. The stantion fasteners may be any of a wide variety of devices, but it is preferred that the stantion fasteners be simply screws, bolts or the like, which can easily be removed by the homeowner, for example, when changing a bulb, or in the event that reflector 9 has been discolored or rendered dirty or corroded in the atmosphere of the light housing interior. This makes very simple removal and replacement of the reflector by the homeowner.

A very economical way of producing a satisfactory reflector is that of stamping a thin metal sheet such that the ends are bent at angles to the sheet. When the reflector is installed in the light housing, as explained above, the reflector is manually bent to a curvature, as explained above, and secured in that curvature, and under tension, to stanchions 58 by stanchion fasteners 59.

In order for the homeowner to easily remove lens 5, it is preferred that lens 5 is attachable to front side 6 of light housing 1 by removable housing fasteners 44, as noted above. More preferably, the housing fasteners 44 engage a plurality of abutments 60 (see FIG. 1) disposed outside of a periphery 61 of lens 5 and outside of a periphery 62 of the front side 6 of light housing 1 (see FIG. 1).

With the above-described arrangement, if a bulb in the lighting device burns out, the bulb is manually removable from and replaceable into the bulk socket by the simple operations described above which can be carried out by the homeowner. In addition, with the above arrangement, the device is easily installed and maintained by the homeowner, and with the preferred safety sensors, the device can be safely operated by the homeowner.

Figure 9:
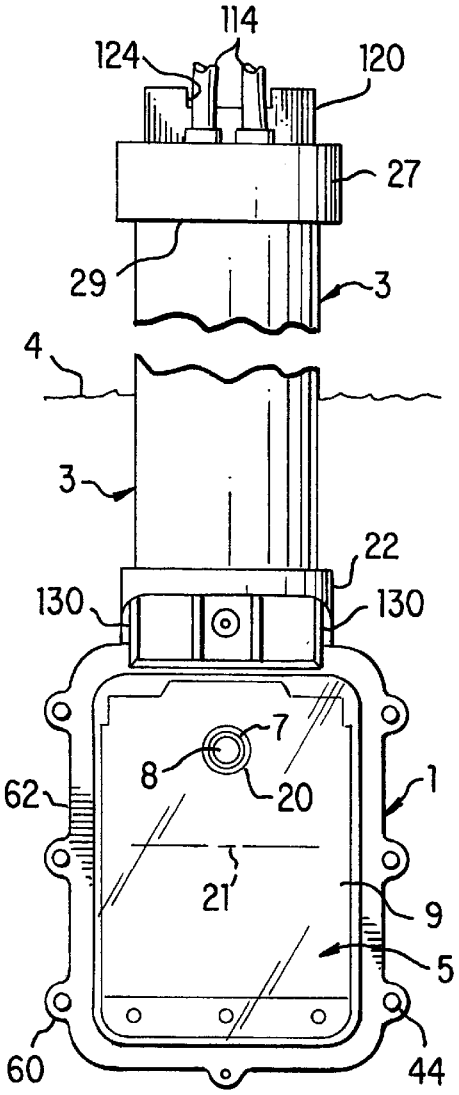
FIGS. 9 and 10 are a front view and side view, respectively, of the light housing and elongated connector with the mounting bracket of the embodiment of FIG. 8.
Figure 10:
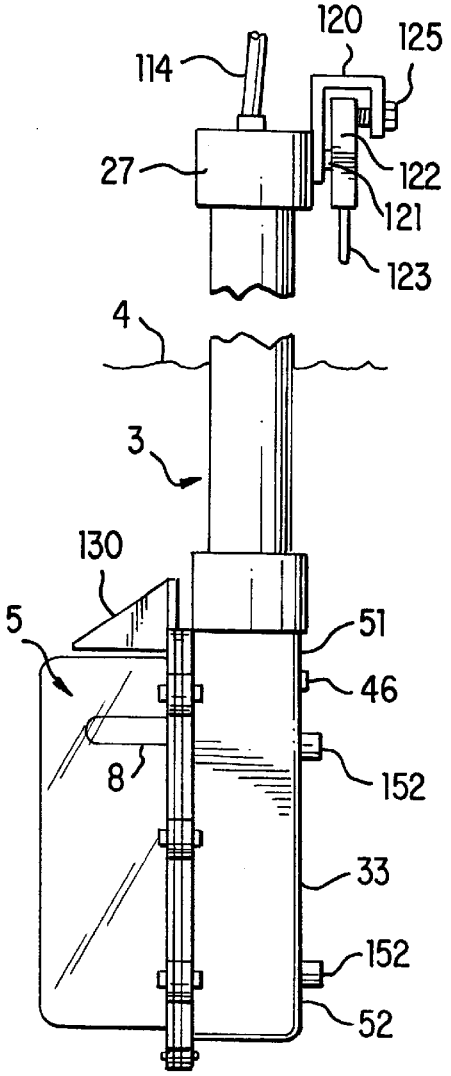
Figure 8:
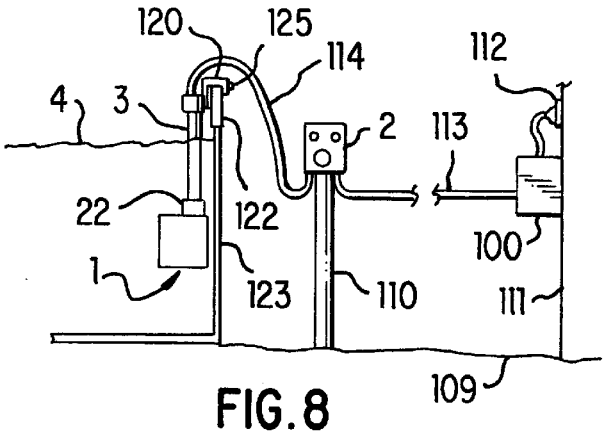
FIG. 8 is a schematic side view of another embodiment of the device of the present invention.

Another embodiment is shown in FIGS. 8, 9 and 10, where the same elements are indicated by the same reference numerals as used in FIGS. 1–7. In this embodiment, the control housing 2 is not mechanically connected to the connector 3, but spaced from the connector 3, as shown in FIG. 8, and mounted on a separate support 110 placed, for example, in the ground 109, which support 110 may be independent of the pool, as shown in FIG. 8, or a conventional vertical post which supports the pool (not shown in FIG. 8). In addition, in this embodiment, the transformer 100 (see FIG. 2) is shown separated from control housing 2 and mounted on a convenient support a distance from the pool, e.g. on wall 111 of a house, and near a convenient 120 volt/220 volt outlet 112. The transformer 100 is electrically connected to control housing 2 by wires 113 and the control housing 2 is electrically connected to connector 3 and light housing 1 by wires 114.

This embodiment has the added advantage of being even more safe than the previously described embodiment in that the control housing 2 and, especially, the 120 volt/220 volt to 12 volt transformer 100 are spaced further from the pool water. The embodiment has the disadvantages of being more expensive to manufacture (added housings, wires, etc.) and requires separate installations of the connector 3/light housing 1/control housing 2 and transformer 100. Nevertheless, it is believed that the above advantage outweighs the disadvantages and is a preferred embodiment.

In this embodiment, however, another means of securing connector 3 and light housing 1 to the pool is required. While this attachment may be as desired, a preferred attachment for above-ground pools is that of a bracket 120 attached, e.g. by screws 121 (see FIG. 10) to connector portion 27. With such a bracket 120, the top ledge of an above-ground pool is removed and the bracket 120 is mounted on the liner rail 122 that holds the pool liner 123 in place at the top of the pool wall. The bracket 120 is secured to the liner rail 122 by way of a fastener 125 which may be any conventional fastener, e.g. screws, bolts, etc. Wires 114 may be smugly received in a recess 124 in bracket 120 (see FIG. 9).

Alternatively, but not as preferred, instead of transformer 100 being separated from control housing 2, as shown in FIG. 8, the transformer 100 may be in control housing 2, as shown in FIG. 2.

Also as shown in FIGS. 9 and 10, lens 5 may have stiffening elements 130 as part of lens 5, and these stiffening elements may be placed at any portion of lens 5.

The remainders of the embodiment of FIGS. 8 through 10 are the same as described in connection with FIGS. 1 through 7.

Figure 11:
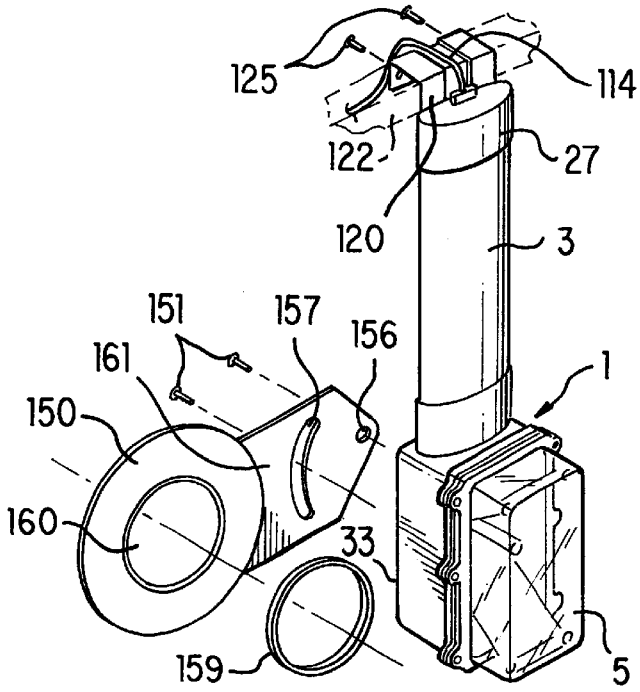
FIGS. 11 and 12 show an optional additional mounting anchor.
Figure 12:
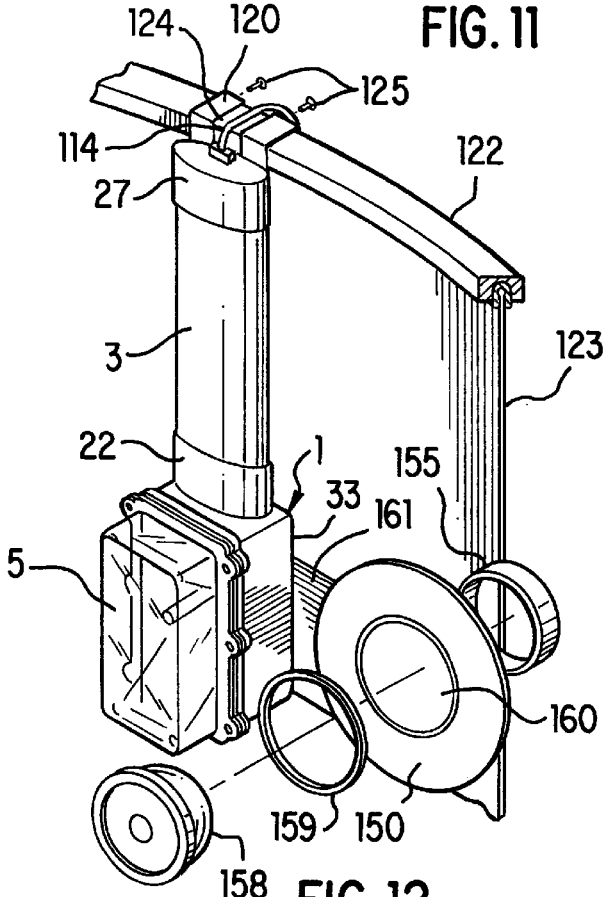

FIGS. 11 and 12 shown an optional mounting device. As noted above, since light housing 1 is water tight and, most preferably, the connector 3 is water tight, these two elements are filled with air. Thus, both elements will have some buoyancy. Particularly, if the clamp 42 (see FIG. 2) or the bracket 120 (see FIG. 10), or other attachments, are not secured to a rigid part of the pool, as described above, there is a tendency for light housing 1 to float and, thus, move from a vertical position in the pool, as shown in FIGS. 1, 2, 8, 9 and 10, to an inclined position, which will, of course, incorrectly aim lens 5 upwardly. In such situations, additional mounting of light housing 1 to the pool is desirable.

Most above-ground pools have at least one water return fitting in the pool liner and wall for returning pool water to a filter for filtering the water and returning the water to the pool. When the present lighting device is installed next to such return fitting, the lighting device may also be anchored to that return fitting to counteract possible buoyancy of the light housing 1 and connector 3. FIGS. 11 and 12 show an embodiment of such an additional anchor. In FIGS. 11 and 12, the same elements are indicated by the same reference numerals as in the foregoing figures.

As shown in FIGS. 11 and 12, an anchor 150 is mounted by anchor fasteners 151, e.g. screws, bolts, etc., to the back side wall 33 of light housing 1 by means of hollow protrusions 152 (see FIG. 10) extending from back wall 33. One set of upper protrusions 152 and one set of lower protrusions 152 are shown in FIG. 10. The two sets of protrusions provide some latitude in mounting anchor 150 for particular positions of pool return fitting 155 (see FIG. 12). One fastener 151 passes through fastener hole 156 (see FIG. 11) and one through slot 157. Slot 157, thus, provides further adjustment for fitting anchor 150 to return 155.

To attach anchor 150 to return 155, the conventional "eyeball" (directional fitting) 158 (see FIG. 12) is removed from return 155 and anchor 150 is adjusted by way of slot 157 to fit anchor 150 onto the return 155 by using one or more spacer washers 159. It will be noted that anchor 150 has an aperture 160 and a flange 161, which latter contains fastener hole 156 and slot 157. After the aperture 160 is fitted over return 155, anchor fasteners 151 are tightened and"eyeball" 158 is threaded into return 155 so as to secure light housing 1 and connector 3 in a vertical position in the pool.

As noted above, this anchor arrangement is particularly useful when the liner rail 122 is not particularly rigid, e.g. a small liner rail 122, as shown in FIG. 12. It can also be useful when substantial wave action is expected in the pool, since it minimizes the lateral torque placed, especially, on bracket 120, although the anchor is also useful when the light is mounted with clamp 42, as shown in FIG. 2.

For reasons of safety, the entire electrical circuit of the control housing 2, light housing 1 and connector 3 is operated at a reduced, safe voltage, e.g. less than 24 volts, especially 12 volts. As shown in FIGS. 2 and 10, the 120 volt/220 volt power supply 24 is decreased by transformer 100 (see FIGS. 2 and 10) to 12 volts.

Figure 13:
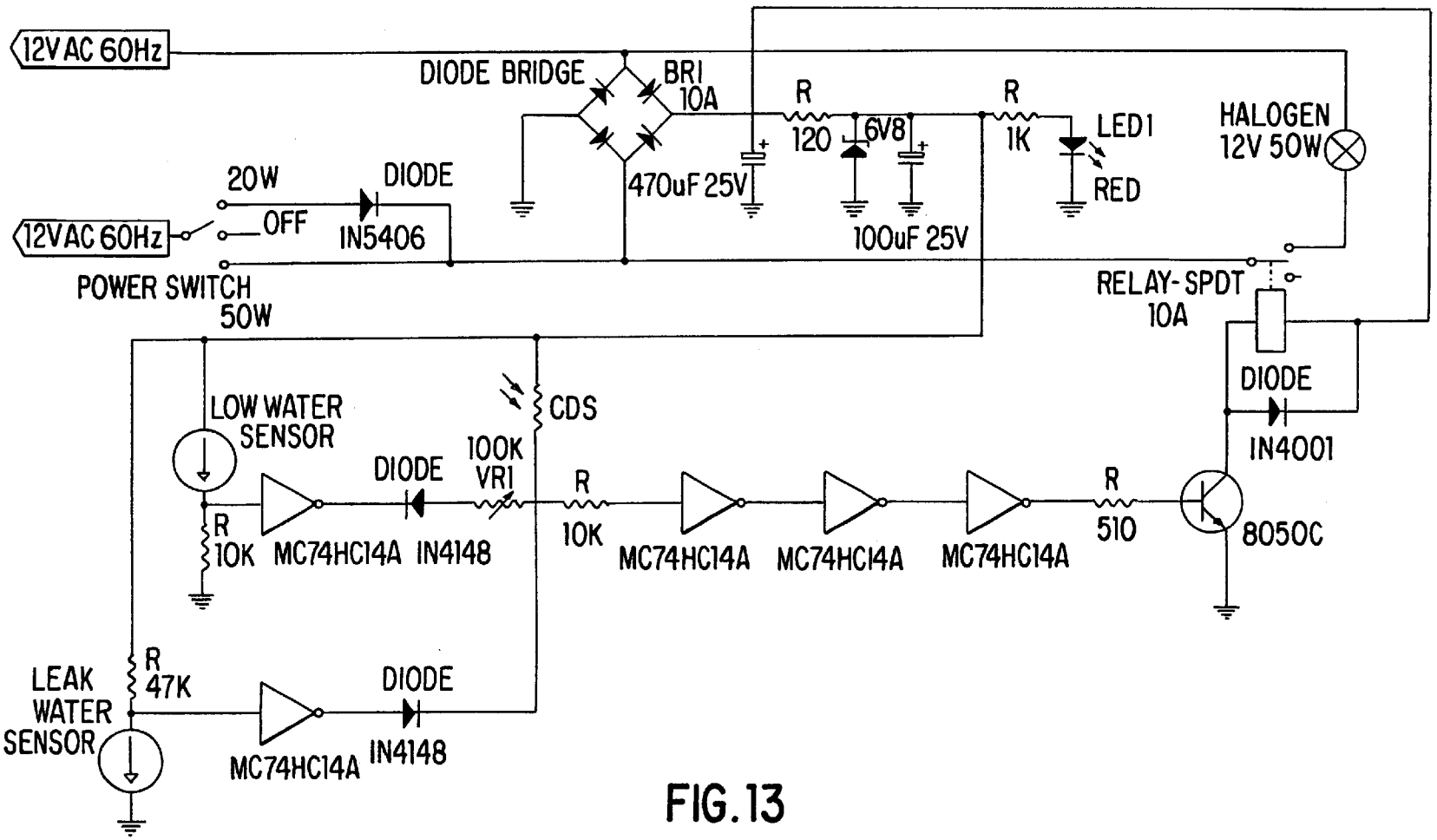
FIG. 13 is a circuit diagram of a typical circuit for the lighting device.

The circuitry can be as desired using conventional electrical and electronic components and no special circuitry is required. However, a typical circuitry is shown in FIG. 13 where the components thereof are identified by conventional notations.

Thus, by using the separated components and light housing with the present reflector, as described above, the present device can provide very special advantages for lighting swimming pools. Especially important in this regard is the concaved reflector and placement of the light source. With the reflector being concaved in the vertical direction and essentially entirely open in the horizontal direction, as shown in FIGS. 2, 4, 5 and 6, the emitted light will illuminate essentially all of the pool. Also, since the emitted light is not substantially lost through the surface of the water, the light source can be of substantially lower wattage than would be required by a conventional lighting device.

Thus, having described the invention, it is intended that the claimed invention extend to the spirit and scope of the annexed claims.

What is claimed is:

1. An underwater safety lighting device for lighting water beneath a surface of the water in a swimming pool, comprising:

(1) a water-tight light housing (1) disposable beneath the surface (4) of the water and comprising an at least partially transparent lens (5) removably attached to a front side (6) of the light housing (1) in a water-tight manner, a light-emitting source (12) secured within the light housing, a concaved light reflector (9) secured within the light housing and disposed such that the light-emitting source (12) is above a conjugate axis (21) of the concaved light reflector (9), an aperture (20) disposed entirely in an upper one-half (21) of the light reflector (9) for receiving therethrough the light-emitting source (12) and a light housing connection portion (22);

(2) a control housing (2) disposable out of the water in the pool and comprising a power source (24) and a control device (26); and (3) an elongated connector (3) comprising a lower connector end (28) for connecting to the light housing connection portion (22), an upper connector end (29) for connecting to an upper portion of the pool and a passageway (30) in the elongated connector for passing electrical wires (31) from the control housing (2) to the light housing (1).

2. The device of claim 1, wherein a low water sensor (46) interrupts power to the light housing (1) by action of the control device (26) when the light housing (1) is not beneath the surface of the water.

3. The device of claim 1, wherein a leak water sensor (50) interrupts power to the light housing (1) by action of the control device (26) when water leaks into the light housing (1).

4. The device of claim 2, wherein the low water sensor (46) is disposed on an upper outside portion (51) of the light housing (1).

5. The device of claim 3, wherein the leak water sensor (50) is disposed within the light housing at a lower portion (52) thereof.

6. The device of claim 1, wherein a power on indicator (53) indicates when power is passing from the power supply housing (2) to the light housing (1).

7. The device of claim 6, wherein the power on indicator is a visible lamp.

8. The device of claim 1, wherein a light sensor (54) interrupts power to the light housing (1) by action of the control device (26) when the light sensor (54) is exposed to light.

9. The device of claim 1, wherein the light housing (1) is made of non-electrical conductive and water resistive material.

10. The device of claim 9, wherein the connector (3) is made of non-electrical conductive and water resistive material.

11. The device of claim 10, wherein the control housing (2) is made of non-electrical conductive and water resistive material.

12. The device of claim 1, wherein the connector (3) has a length of at least 3 inches.

13. The device of claim 1, wherein the light reflector (9) is made of a corrosion-resistant material.

14. The device of claim 1, wherein the lens (5) is attached to the front side (6) of the light housing (1) with a removable waterproof gasket (45) disposed between the front side (6) of the light housing (1) and the lens (5).

15. The device of claim 14, wherein the lens (5) is attached to the front side (6) of the light housing (1) by removable housing fasteners (44).

16. The device of claim 15, wherein the housing fasteners (44) engage a plurality of abutments (60) disposed outside of a periphery (61) of the lens (5) and outside of a periphery (62) of the front side (6) of the light housing (1).

17. The device of claim 1, wherein a bulb (8) is manually removable from and replaceable into a bulb socket (7).

18. The device of claim 1, wherein the upper connector end (29) is connected to a control housing connection portion (27) and the control housing (2) is connectable to supports.

19. The device of claim 1, wherein the upper connector end (29) has attached thereto a bracket (120) which is connectable to supports (23, 122) and the control housing (2) is disposed outside of the pool and electrically connected to light housing (1) by wires (114).

20. The device of claim 19, wherein an electrical transformer (100) spaced from the control housing (2) is electrically connectable to control housing (2) by wires (113).

21. The device of claim 1, wherein an anchor is attached to light housing (1) and to a pool water return (155).

22. The device of claim 21, wherein the anchor is adjustable.

* * * * *